United States Patent [19]

Pernet et al.

[11] 4,039,208

[45] Aug. 2, 1977

[54] DEVICE FOR LOCKING AND UNLOCKING TWO CONCENTRIC PIPES

[75] Inventors: Jacques M. Pernet, Cazeres sur Garonne, France; Donald F. Taylor, Dallas, Tex.

[73] Assignee: Subsea Equipment Associates Limited, Hamilton, Bermuda

[21] Appl. No.: 587,744

[22] Filed: June 17, 1975

[30] Foreign Application Priority Data

June 17, 1974 France ..... 74.20869

[51] Int. Cl.[2] ..... F16L 35/00

[52] U.S. Cl. ..... 285/3; 285/24; 285/138; 285/140; 285/261; 285/317

[58] Field of Search ..... 285/3, 4, 18, 24, 27, 285/140, 141, 142, 143, 261, 319, 307, 316, 317, 138; 166/.6, 208, 274

[56] References Cited

U.S. PATENT DOCUMENTS

| | | | |
|---|---|---|---|
| 3,090,438 | 5/1963 | Roulins | 285/140 |
| 3,139,141 | 6/1964 | Fredd et al. | 166/208 |
| 3,288,493 | 11/1966 | Brown | 285/3 |
| 3,356,389 | 12/1967 | Fredd | 285/141 X |
| 3,791,442 | 2/1974 | Watkins | 285/18 |

FOREIGN PATENT DOCUMENTS

| | | | |
|---|---|---|---|
| 1,330,153 | 5/1963 | France | 166/.5 |

*Primary Examiner*—Dave W. Arola

*Attorney, Agent, or Firm*—Sughrue, Rothwell, Mion, Zinn and Macpeak

[57] ABSTRACT

A device for locking and unlocking two concentric pipes, for example extending between an underwater oil well and a surface apparatus, comprising first and second locking means on one of said pipes and at least two stop means on the other of said pipes operative to limit relative movement of said pipes in the connection direction and to prevent relative movement of said pipes, when locked together, in the disconnection direction, wherein locking and unlocking is effected solely by relative axial movement of the pipes.

11 Claims, 4 Drawing Figures

2
14
16
20
18
16
18
30
13
34
19
38
35
33
21
37
23
36
22
24
22
25
26
27
31
31
17

DEVICE FOR LOCKING AND UNLOCKING TWO CONCENTRIC PIPES

The invention relates to a device for locking and unlocking two concentric pipes and is particularly but not exclusively applicable to the case where one of the pipes is relatively fixed and connects an underwater oilwell to an operating surface vessel.

There is a very large number of connector devices for locking and unlocking pipes. These devices, however, are often complicated, have limited use, and are not suitable for performing a connection with quick locking and unlocking when the connection must be remotely operated, and, especially, when the connection is between the end of a connector pipe hung from a surface apparatus and the inner casing of an underwater oilwell. There are plenty of devices designed for performing an underwater connection but they all necessitate rotation of one pipe with respect to the other, which is a method that cannot always be conveniently and effectively employed once the well is located at a certain depth under water.

Inasmuch, as during the course of drilling or exploitation of an underwater oilwell, one may have to perform a rapid unlocking of the connector pipe from the surface apparatus to the well casing, it can be seen that the known devices are not suitable.

It is an object of the present invention to provide a device for axial connection of two pipes, in which locking and unlocking are carried out solely by means subject to axial forces in opposite directions, said means being provided on the end of one of the pipes and including a first and a second locking means.

If the inner one of the pipes is connected to a vessel or any other surface apparatus, the forces applied being vertical and the weight of the inner pipe being sufficient to ensure operation of the locking means, it can be seen that hoist winches should be sufficient to ensure operation of unlocking. Again, as no rotational force need be used, a connector device can be employed which comprises a ball joint the role of which is to eliminate bending forces which may be exerted on the inner pipe and consequently transmitted to parts of the pipe not controlled by the inner wall of the other pipe, which may be a riser connecting a well to the surface apparatus.

Another object of the invention is to provide a device of this type, in which a first locking means is operative to prevent any further penetration of one pipe into the other and of a second locking means prevents separation of the pipes.

Thus, even in the event of a force in the opposite direction tending to separate the pipes being exerted on the pipes, no separation can be effected so long as this force is less than a predetermined value which is a function of the maximum such force to which these pipes will be subjected during the course of exploitation.

Another object of the invention is to provide a device of this type, including means of guidance and sealing means for rendering the connection fluid-tight whatever the positions of the locking means and enabling an entirely new connection to be made after withdrawal of one of the connected pipes.

Another object of the invention is to provide a device of this type, which includes in addition two ball-joint means enabling the balljoint of the inner pipe to be passed through the outer pipe and the locking device to be kept in a position either centred or off-centre.

The present invention will be more fully understood following description of an embodiment thereof, given by way of example only, with reference to the accompanying drawings.

Figure 1:
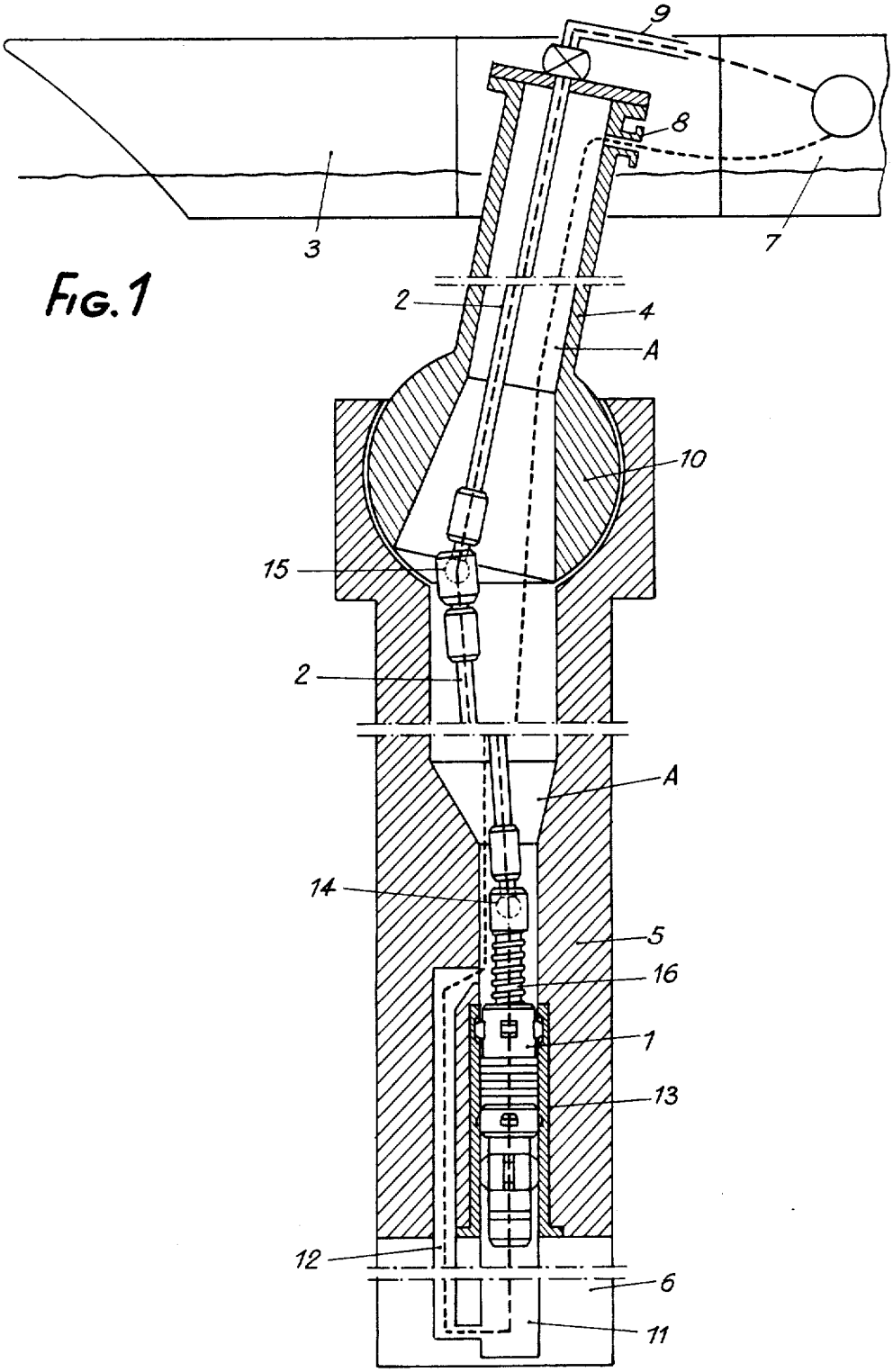
FIG. 1 is a diagrammatic representation of a connecting pipe extending from a surface vessel to an underwater well and provided with a device in accordance with the invention.

In FIG. 1, a connecting tool 1 for locking the lower end of an inner connecting pipe 2 to a seating 13 which is fast with the lower end portion 5 of an outer concentric pipe, to connect the lower end of the outer pipe to an operating means on a vessel 3 or any surface apparatus, has been shown diagrammatically. The fixed portion 5 of the outer pipe is connected with an underwater well 6 in known manner and a movable portion 4 of the outer pipe, the lower end of which is formed by a balljoint 10 movable in a seating in the upper end of the fixed portion 5, likewise is connected with a surface vessel 3 in known manner. As these connections are known they have not been shown in detail. In order to indicate briefly an example of the operation of the whole apparatus, a pump has been shown at 7, which pump serves for the circulation of mud which is sent, for example, through the piping 9 to the connecting pipe 2, down to the bottom of the well whence it returns along the path 12, the annulus A and the piping 8 to the pump 7.

In order to enable effective locking and unlocking of the connecting tool 1 by simple axial pressure or traction exerted on the connecting pipe 2 without causing bending of the pipe 2 during manipulation, two balljoint connections 14, 15 are provided. Connection 14 is provided at the lower end of the connecting pipe 2, and connection 15 is provided at the level of the lower end of the inside portion of the balljoint 10. In addition the seating 13 which is intended for correct anchorage of the tool 1 is provided at the lower end of a guide zone constituted by the inner face of the lower portion 5 of the outer pipe. It is clear that because of the balljoint articulations 14 and 15, the tool 1 can be locked onto the seating 13 whatever the normal variations in position of the vessel 3.

Figure 2:
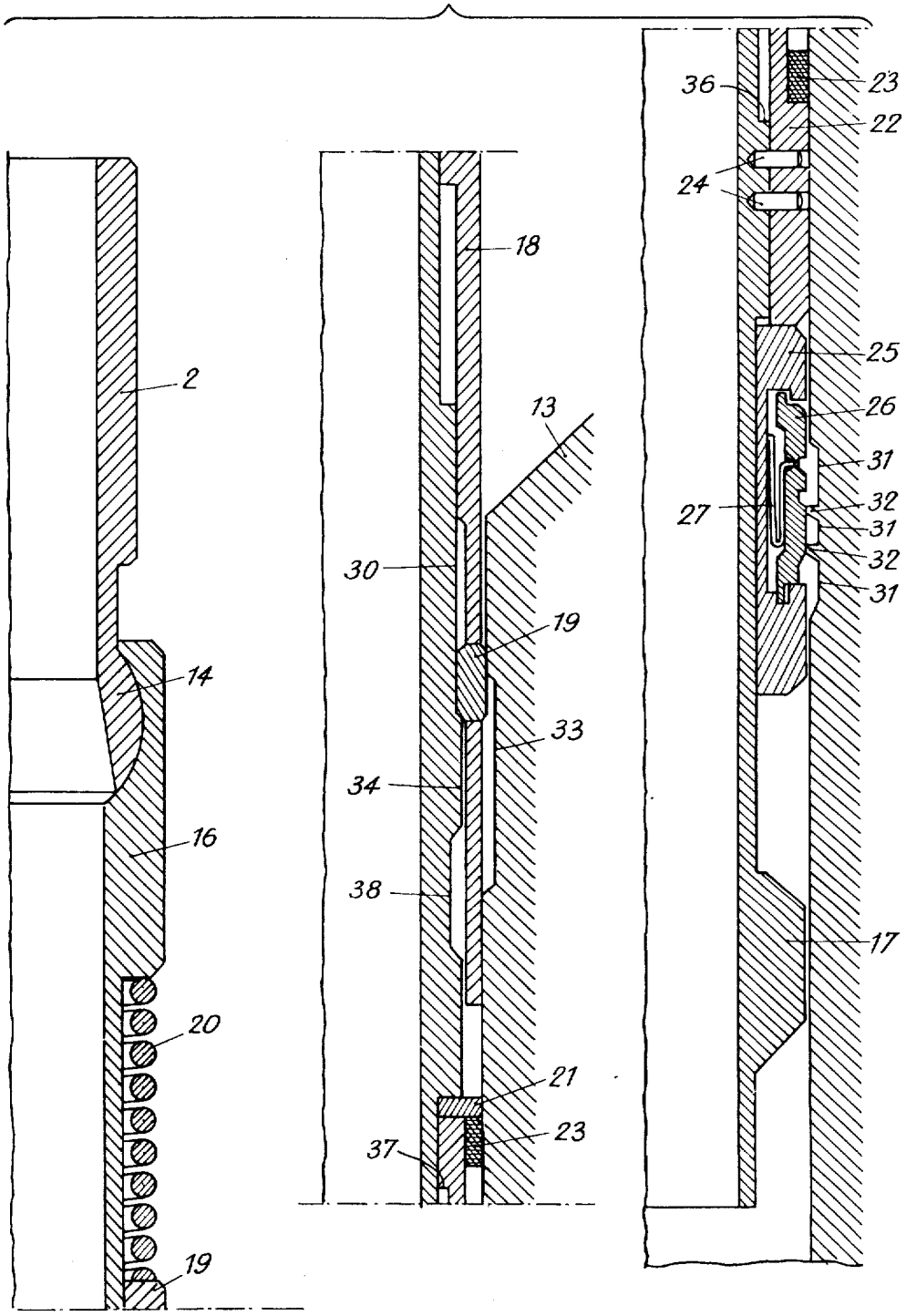
FIG. 2 shows the device partially in axial section and immediately before it is locked in position.

The seating 13 has first stop means in the form of a recess 33 (FIG. 2) in its upper portion and second stop means in the form of three circular grooves 31 separated by two shoulders 32 in its lower portion.

The tool 1 comprises a central body 16 receiving the balljoint 14 of the connector pipe 2, a sleeve 18 bearing locking fingers 19 and loaded by a spring 20, an upper ring 22 attached by shearpins 24 to the body 16 and carrying sealing packings 23, and a lower ring 25 bearing locking keys 26.

In order to ensure guidance of the tool 1 during the course of its penetration into the seating 13, a centering guide 17 of cruciform transverse section is provided in the lower end of the body 16. A bearing 21 fast with the upper ring 22 serves as a point of support for the lower end of the sleeve 18 as it slides relative to the body 16. The lower ring 25 is also free to slide on the body 16 between the fixed centering guide 17 and the upper ring 22.

During lowering of the tool 1 under its own weight and that of the connector pipe 2, the frictional forces of the keys 26, urged outwardly by springs 27, against the inner wall of the seating 13 bring them to a stop relative to the seating 13 and hence cause sliding of the ring 25 on the body 16. In continuing its descent, the body 16 compresses the spring 20 and then drives the ring 25 downwardly by abutment of the ring 25 with the lower end of the ring 22. The ring 25 is driven down until the keys 26 present themselves opposite the three grooves 31 and are thrust outwardly and into engagement with the grooves 31 by the springs 27. The ring 25 is then in its lower stop position in abutment with the shoulders 32. During the course of this lowering movement the fingers 19 in the sleeve 18 remain in contact with the face 30 of the body 16 until they arrive at the level of the recess 33 in the seating 13 into which they enter under the action of the chamfered shoulder 34 of the body 16 and the spring 20 which is released, bringing the lower end of the sleeve 18 into contact with the bearing 21 on the ring 22.

Figure 3:
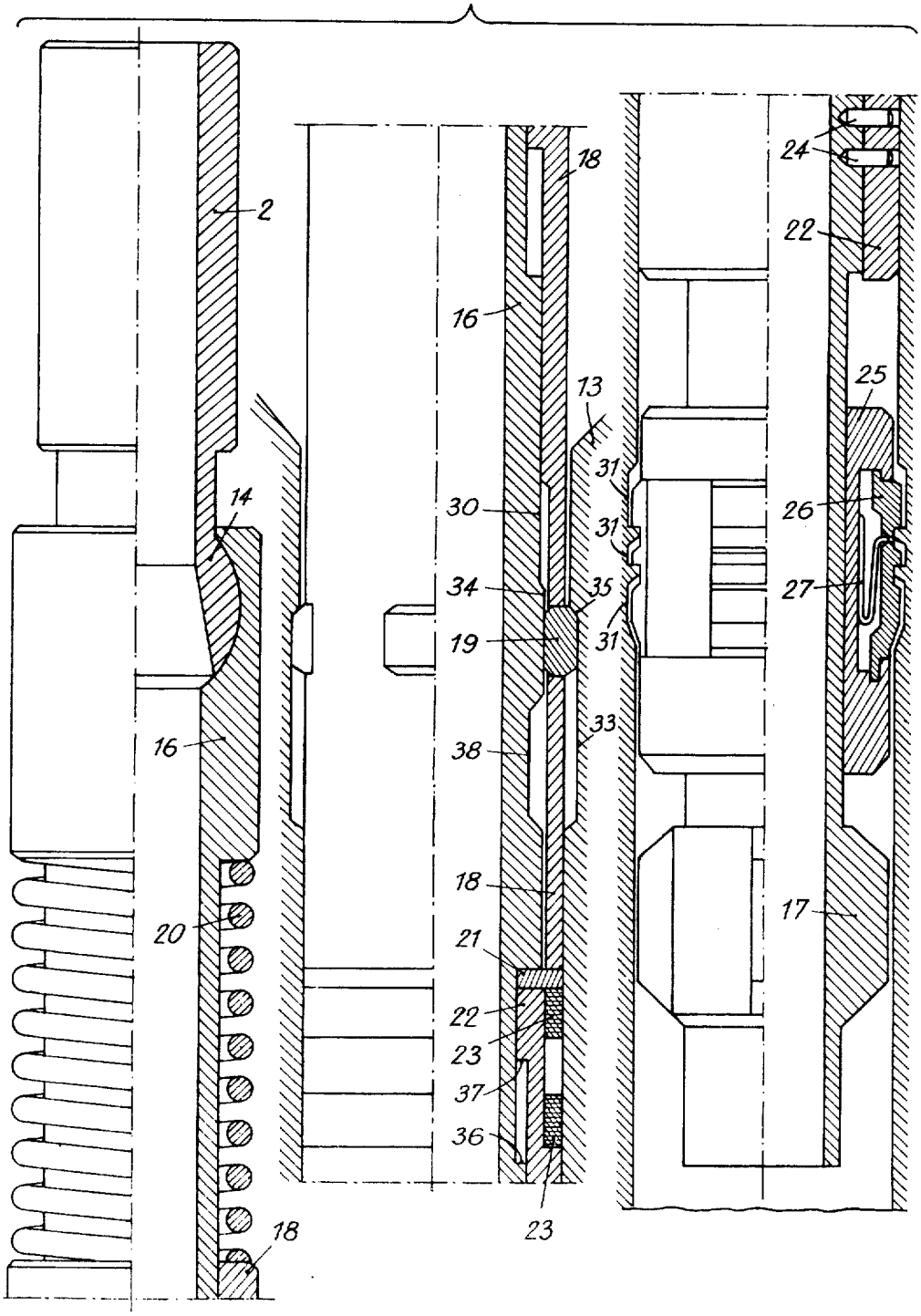
FIG. 3 shows the device partially in section after it has been locked in position and FIG. 4 shows the device after it has been unlocked.

It is clear that, under these conditions, the body 16 of the tool 1 is locked in a lower position by the ring 25 which is held by engagement of the keys 26 in the recess 31. It will be observed further that the tool is also locked against upwards movement, because during the course of such movement, the body 16 moves the ring 22 and the bearing 21 through the pins 24, and the bearing 21 urges the sleeve 18 and consequently the fingers 19 upwards until the fingers 19 abut against the upper edge 35 of the recess 33 (FIG. 3), the shoulder 34 preventing any radial movement of the fingers 19.

Sealing is ensured by the packings 23 housed in a recess in the ring 22 and slidable fluid-tightly against the inner wall of the seating 13 in the portion lying between the grooves 31 and 33.

Figure 4:
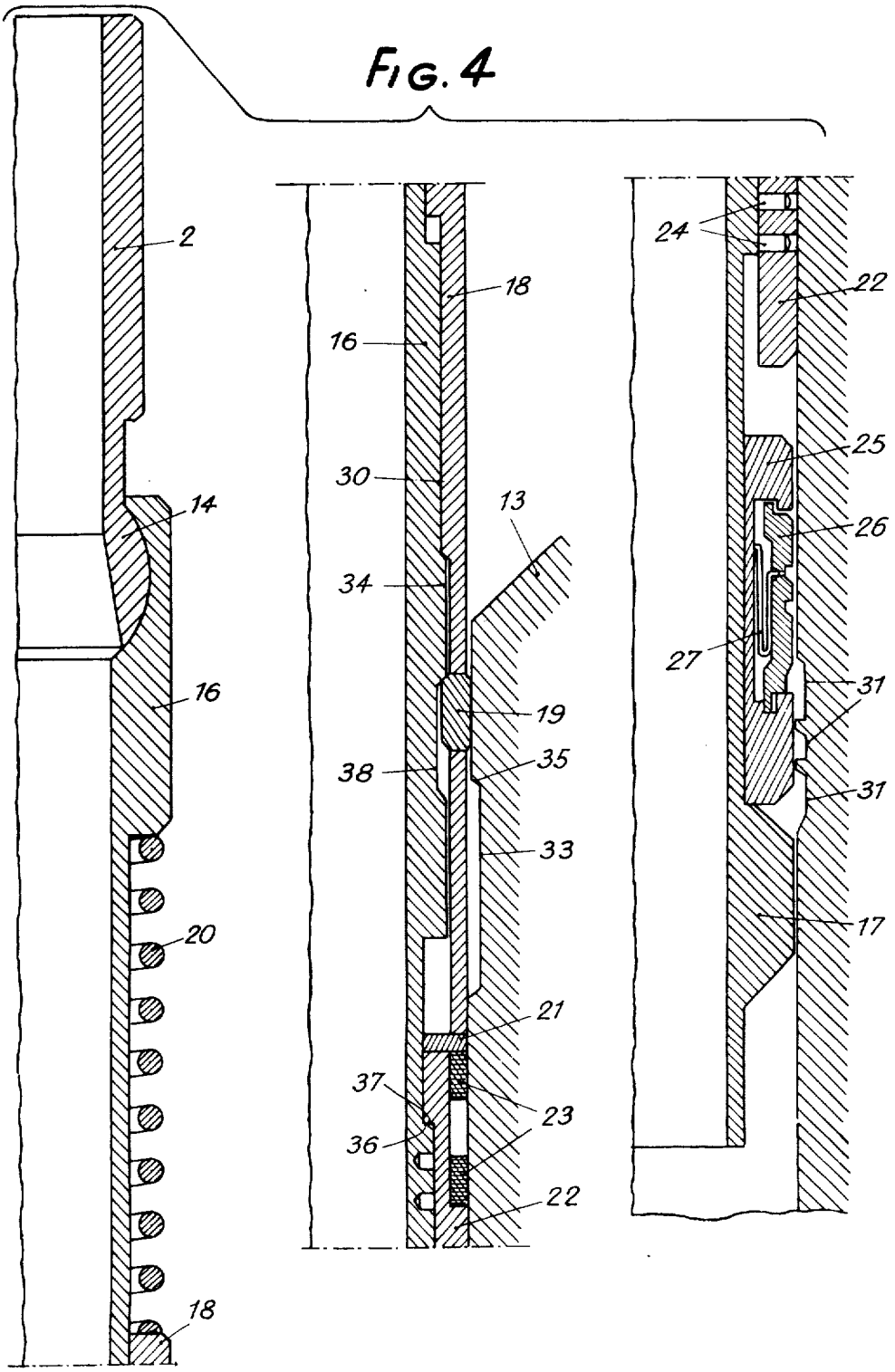

When it is required to unlock the tool 1 it is sufficient to exert on the pipe 2 a vertical upward force sufficient to shear the pins 24 holding the ring 22 to the body 16 (FIG. 4). In fact with movement of the ring 22 upwards being limited by the abutment of the fingers 19 (FIG. 3) with the edge 35 of the recess 33 in the seating 13, it can be seen that only the pins 24 prevent further movement of the body 16. As soon as shearing of the pins 24 takes place, the body 16 can continue its upward movement, the fingers 19 being unlocked upon passing of the shoulder 34, the fingers 19 being then free to fall more radially into a cylindrical recess 38 (FIG. 4) in the body 16.

Raising of the ring 25 is effected easily by the centreing guides 17 which drive it upwardly during the raising of the body 16, the bevels on the upper portions of the keys 26 and the grooves 31 facilitating retraction of the keys radially inwards. A shoulder 36 on the body 16 provides an abutment for a shoulder 37 on the ring 22, thus ensuring raising of the ring 22.

What is claimed is:

1. A device for locking and unlocking two concentric pipes comprising:

a first and second locking means on one of said pipes and slidable longitudinally relative thereto;

at least two stop means for said first and second locking means on the second of said pipes;

means for urging said first locking means towards one of said stop means on introduction of said one pipe into said second pipe by relative movement in a first longitudinal direction;

means for urging said second locking means towards the other of said stop means on movement of said one pipe relative to said second pipe in a longitudinal direction opposite to said first direction; and means for displacing radially said first and second locking means after movement in the first longitudinal direction.

2. A device as claimed in claim 1, including sealing means positioned between said first and second locking means.

3. A device as claimed in claim 1, including means on said one pipe serving as a drinking abutment for said first locking means on introduction of said one pipe into said second pipe.

4. A device as claimed in claim 1, including means serving as a retaining abutment for said second locking means when urged against said other stop means on movement of said one pipe in said direction opposite to said first direction.

5. A device as claimed in claim 1, wherein said one stop means is inactive upon withdrawal of said one pipe.

6. A device as claimed in claim 5, wherein said other stop means is formed by an inclined surface constituting the edge of a recess and the one pipe includes a shoulder for maintaining said second locking in said recess and a ring for maintaining said second locking means applied against said incline when said second locking means cooperates with the other stop means, said ring being held to said one pipe by shearpins.

7. A device as claimed in claim 1, wherein said one pipe is for connection of the inner casing of an undersea oilwell and includes at least one balljoint adjacent thereto.

8. A device for locking and unlocking two concentric pipes comprising:

a first and a second locking means on one of said pipes and slidable longitudinally relative thereto;

at least two stop means for said first and second locking means on the second of said pipes;

means for urging said first locking means towards one of said stop means on introduction of said one pipe into said second pipe by relative movement in a first longitudinal direction;

means for urging said second locking means towards the other of said stop means on movement of said one pipe relative to said second pipe in a longitudinal direction opposite to said first direction; and means serving as a retaining abutment for said second locking means when urged against said other stop means on movement of said one pipe in said direction opposite to said first direction, said abutment means locked to said one pipe by shearpins.

9. A device as claimed in claim 8, wherein said second locking means is urged towards said abutment means by a spring so as to bring said locking means level with a shoulder on said one pipe locking it radially against said other stop means on said second pipe.

10. A device for locking and unlocking two concentric pipes comprising:

a first and a second locking means on one of said pipes;

at least two stop means for said first and second locking means on the second of said pipes;

means for urging said first locking means towards one of said stop means on introduction of said one pipe into said second pipe by relative movement in a first longitudinal direction;

means for urging said second locking means towards the other of said stop means on movement of said one pipe relative to said second pipe in a longitudinal direction opposite to said first direction; wherein one of said stop means being inactive upon withdrawal of said one pipe and the other of said other stop means formed by an inclined surface constituting the edge of a recess and the one pipe includes a shoulder for maintaining said second locking means in said recess and a ring for maintaining said second locking means applied against said incline when said second locking means cooperates with the other stop means, said ring being held to said one pipe by shearpins, and wherein said shoulder is adjacent a groove such that on fracture of said shearpins said groove is moved to a position opposite said second locking means which thereby becomes free to slide over said inclined surface.

11. A device as claimed in claim 10, including a centering guide on said one pipe for withdrawing the whole of said one pipe after fracture of said pins.

* * * * *